US009392847B2

(12) United States Patent
Oda et al.

(10) Patent No.: US 9,392,847 B2
(45) Date of Patent: Jul. 19, 2016

(54) SLIDER FOR SLIDE FASTENER WITH AUTOMATIC STOP DEVICE AND METHOD FOR MANUFACTURING SAME

(75) Inventors: Kiyoshi Oda, Toyama (JP); Keiichi Keyaki, Toyama (JP); Yoshikazu Hamada, Toyama (JP)

(73) Assignee: YKK Corporation (JP)

( * ) Notice: Subject to any disclaimer, the term of this patent is extended or adjusted under 35 U.S.C. 154(b) by 294 days.

(21) Appl. No.: 14/008,249

(22) PCT Filed: Mar. 31, 2011

(86) PCT No.: PCT/JP2011/058255
§ 371 (c)(1),
(2), (4) Date: Sep. 27, 2013

(87) PCT Pub. No.: WO2012/131991
PCT Pub. Date: Oct. 4, 2012

(65) Prior Publication Data

US 2014/0013549 A1 Jan. 16, 2014

(51) Int. Cl.
*A44B 19/30* (2006.01)
*B21D 53/54* (2006.01)

(52) U.S. Cl.
CPC ..... *A44B 19/303* (2013.01); *A44B 19/30* (2013.01); *A44B 19/308* (2013.01); *B21D 53/54* (2013.01); *Y10T 24/2561* (2015.01); *Y10T 29/49783* (2015.01)

(58) Field of Classification Search
CPC ... A44B 19/303; A44B 19/306; A44B 19/308
See application file for complete search history.

(56) References Cited

U.S. PATENT DOCUMENTS

| | | | | |
|---|---|---|---|---|
| 4,768,263 | A * | 9/1988 | Fukuroi et al. | 24/418 |
| 5,806,151 | A | 9/1998 | Uchiyama | |
| 6,009,602 | A | 1/2000 | Terada | |
| 8,959,727 | B2 * | 2/2015 | Keyaki et al. | 24/421 |
| 2011/0197402 | A1 * | 8/2011 | Keyaki et al. | 24/386 |

FOREIGN PATENT DOCUMENTS

| | | | | |
|---|---|---|---|---|
| EP | 1762153 | * | 3/2007 | A44B 19/306 |
| JP | S49-43446 | | 11/1974 | |
| JP | 52-10402 | | 1/1977 | |
| JP | S62-41608 | | 10/1987 | |

(Continued)

OTHER PUBLICATIONS

International Preliminary Report on Patentability, PCT Application No. PCT/JP2011/058255, mailed Oct. 2, 2013.

(Continued)

*Primary Examiner* — Robert J Sandy
(74) *Attorney, Agent, or Firm* — Kilpatrick Townsend & Stockton LLP

(57) ABSTRACT

A method for manufacturing a slider for a slide fastener with an automatic stopper. A common part which includes a stopping pawl portion, a biasing portion and a cover portion and forms the automatic stopper is provided. At least two bodies selected from among a first body having a guide recess configured to guide metal teeth, a second body having a guide recess configured to guide resin teeth which are formed by injection molding, and a third body having a guide recess configured to guide teeth made of resin monofilaments are prepared. The common part is mounted on one of the bodies selected from the at least two bodies.

12 Claims, 13 Drawing Sheets

(56) References Cited

FOREIGN PATENT DOCUMENTS

| | | | |
|---|---|---|---|
| JP | 10-42913 | A | 2/1998 |
| JP | 11-178615 | A | 7/1999 |
| JP | 2007-111351 | A | 5/2007 |
| JP | 2008-228808 | A | 10/2008 |
| JP | 4628227 | | 11/2010 |
| WO | 2010/073362 | A1 | 7/2010 |

OTHER PUBLICATIONS

Supplementary European Search Report, European Patent Application No. 11862634.0, mailed Feb. 26, 2015.

International Search Report, PCT Application No. PCT/JP2011/058255, mailed May 24, 2011.

* cited by examiner

SLIDER FOR SLIDE FASTENER WITH AUTOMATIC STOP DEVICE AND METHOD FOR MANUFACTURING SAME

This application is a national stage application of PCT/JP2011/058255 which is incorporated herein by reference.

TECHNICAL FIELD

The present invention relates to a slider for a slide fastener with an automatic stop device, and more particularly, to a slider for a slide fastener with an automatic stopper in plural types of fasteners which are formed of a variety of teeth, in which some components of the slider are made as a common part.

BACKGROUND ART

Related-art slide fasteners include a metal fastener which is provided with metal teeth, an injection resin fastener which is provided with resin teeth made by injection molding (hereinafter, referred to as "injection resin teeth"), and a coil-shaped fastener which is provided with teeth made of resin monofilaments (hereinafter, referred to as "coil-shaped teeth"). In these slide fasteners, the sliders have different constructions for engaging and disengaging the metal teeth, the injection resin teeth and the coil-shaped teeth with and from each other, and a variety of shapes of sliders is proposed (e.g. refer to Patent Documents 1 to 4).

When the metal fastener, the injection resin fastener, the coil-shaped fastener or the like is attached to clothes, a slider which has an automatic stopper for stopping the slider from moving by causing a stopping pawl portion provided therein to engage with teeth is used. It is known that the automatic stopper of the slider which has this automatic stopper is configured as one component or a combination of a plurality of components.

Patent Documents 1 and 2 disclose a slider with an automatic stopper which has a stopping pawl portion formed in the rear portion of a cover 118. As shown in FIG. 10, a slider 110A with an automatic stopper which is used for a metal fastener has a stay 112, an engagement post 113, a slot 114 and a pawl hole 115 in the upper surface of a body 111, in which a bar-shaped spring 116 is fitted into the slot 114. A stopping pawl portion 117 protrudes integrally from the rear lower portion of the cover 118. In addition, a pull-tab 119 is disposed between the rod-shaped spring 116 and the cover 118, which is engaged with the stay 112 and the engagement post 113.

In addition, as shown in FIG. 11, a slider 110B with an automatic stopper which is used for a coil-shaped fastener disclosed in Patent Document 3 includes a body 121, a pull-tab 122, an engagement pawl plate 124 which is provided at one end with a stopping pawl portion 123 and has a mountain-like shape with a high middle portion, a plate spring 126 which has notches at both ends, and a cover 127 which has an open lower surface. A front post 128 and a rear post 129 are erected on the upper surface of the body 121, and a pawl hole 130 is formed in the upper surface of the body 121 adjacent to a lateral end. In addition, the pull-tab 122, the engagement pawl plate 124, the plate spring 126 and the cover 127 are sequentially mounted on the upper surface of the body 121.

In addition, as shown in FIG. 12, a slider 110C with an automatic stopper which is used for a coil-shaped fastener disclosed in Patent Document 4 includes a body 131 which has a front attachment post 132 a rear attachment post 133 erected on the upper surface thereof and a pawl hole 134 formed therein; a cover 135 which integrally has a front engaged portion 136, a rear engaged portion 137, an elastic piece 138 and a stopping pawl portion 139; and a pull-tap 140. The pull-tab 140 and the cover 135 are mounted on the body 131.

FIGS. 13A to 13F are views showing the internal structure of individual sliders and a suitable engagement range of a stopping pawl portion with respect to teeth. Arrows in FIGS. 13A to 13F indicate the range of engagement in which the stopping pawl portion effectively acts on the teeth in terms of engagement retention strength in a metal fastener, an injection resin fastener and a coil-shaped fastener.

Specifically, as shown in FIGS. 13A and 13D, a suitable engagement range is set by the range of an arrow A in a slider 100A which is used for a metal fastener having metal teeth 101. In addition, as shown in FIGS. 13B and 13E, in a slider 100B which is used for an injection resin fastener having injection resin teeth 102, a suitable engagement range is set by the range of arrows B1 and B2 so as to avoid the positions of shoulders 102*a* of the resin teeth 102 which are unstable since the engagement position is not set to one position. In addition, as shown in FIGS. 13C and 13F, in the slider 100C which is used for a coil-shaped fastener having coil-shaped teeth 103, a suitable engagement range is set by the range of an arrow C in terms of engagement retention strength so as to avoid an interference with a sewing thread 104. In the meantime, dashed dotted lines shown in FIGS. 13A to 13F indicate an engagement centerline EC that passes through the lateral center of left and right rows of teeth which engage with each other. Here, the engagement centerline EC is identical with a slider centerline SC that passes through the lateral center of a body of a slider.

As such, since the suitable engagement range of the engagement pawl portion differs according to the fastener. Therefore, in each of the sliders shown in FIG. 10 to FIG. 12, the width, length and the like of the pawl or the cover are designed such that the stopping pawl portion is located in the suitable engagement range corresponding to each fastener.

PRIOR ART DOCUMENT

Patent Document

Patent Document 1: Japanese Utility Model Publication S49-43446

Patent Document 2: Japanese Utility Model Application Publication S52-10402

Patent Document 3: Japanese Utility Model Publication S62-41608

Patent Document 4: Japanese Patent No. 4628227

SUMMARY OF INVENTION

Problems to Be Solved by Invention

As described above, each of the metal fastener, the injection resin fastener and the coil-shaped fastener uses a slider for a slide fastener with a dedicated automatic stopper. Therefore, it is required to prepare a manufacturing apparatus or an assembling apparatus for each type of fastener when manufacturing and assembling such a slider. In addition, there is a problem in that a cost for management of a variety of types of parts is increased. Therefore, a common slide that can correspond to a variety of slider fasteners is required.

However, when a slider with the same automatic stopper is intended to be used in another slide fastener which has a different type of teeth, problems occur in terms of an interference with teeth, engagement retention strength or the like and it is difficult to commonly use the slider even though the slider has the same size. For instance, when the slider 100A for a metal fastener shown in FIGS. 13A and 13D in which the suitable engagement range of the stopping pawl portion is located in the range of the arrow A is intended to be used for a coil-shaped fastener as it is, there occurs a problem in that the stopping pawl portion 117 interferes with the sewing thread 104, thereby damaging the sewing thread 104.

In contrast, when the slider 100B for a coil-shaped fastener shown in FIGS. 13C and 13F in which the suitable engagement range of the stopping pawl portion is located in the range of the arrow C is intended to be used for a metal fastener as it is, there occurs a problem in that the stopping pawl portion overlaps a mountain portion 101*a* which forms an engaging portion of the metal teeth 101. The stopping pawl portion interferes with the mountain portion 101*a*, so that a suitable stop lock state cannot be maintained.

In addition, as for the slider 100B for an injection resin fastener, as shown in FIGS. 13B and 13E, the range in which the stopping pawl portion effectively acts partially overlaps another type of slider. However, in the range between the arrows B1 and B2, there is a problem as above with regard to common use of the slider 100B for an injection resin fastener with another type of slider.

Accordingly, the present invention has been made keeping in mind the above problems occurring in the related art, and an object of the present invention is to provide a slider for a slide fastener with an automatic stopper and a method for manufacturing the same, in which an engagement pawl portion, a biasing portion and a cover portion are commonly used among a plurality of types of fasteners. The stopping pawl portion can realize a sufficient amount of engagement retention strength in any type of fastener. It is possible to achieve a reduction in cost due to intensive production of the common part and combined use of manufacturing equipment and an assembling apparatus.

Means for Solving Problems

The object of the present invention is achieved by the following configurations.

(1) A method for manufacturing a slider for a slide fastener with an automatic stopper, including: preparing a common part which includes a stopping pawl portion, a biasing portion and a cover portion and forms the automatic stopper; preparing at least two bodies selected from among a first body having a guide recess configured to guide metal teeth, a second body having a guide recess configured to guide resin teeth which are formed by injection molding, and a third body having a guide recess configured to guide teeth made of resin monofilaments; and mounting the common part on one of the bodies selected from the at least two bodies.

(2) The method according to (1), wherein at least one body of the at least two bodies is provided with a pawl engagement position-changing means.

(3) The method according to (1) or (2), wherein one of the at least two bodies is configured such that a slider centerline that passes through a lateral center of the body and an engagement centerline that passes through a lateral center of left and right rows of teeth which engage with each other are located at different positions.

(4) The method according to (1) or (2), wherein the at least two bodies are configured so as to have different values of distance from a slider centerline that passes through a lateral center of the respective bodies to an engagement centerline that passes through a lateral center of left and right rows of teeth which engage with each other.

(5) The method according to (1) or (2), wherein the at least two bodies are configured so as to have different values of distance from a pawl hole through which the stopping pawl portion protrudes into the guide recess to an engagement centerline that passes through a lateral center of left and right rows of teeth which engage with each other in a lateral direction of the bodies.

(6) The method according to any one of (1) to (5), wherein the stopping pawl portion and the cover portion are integrally provided as one component.

(7) A slider for a slide fastener with an automatic stopper, including: a common part which includes a stopping pawl portion, a biasing portion and a cover portion and forms the automatic stopper; at least one body selected from among a first body having a guide recess configured to guide metal teeth, a second body having a guide recess configured to guide resin teeth which are formed by injection molding, and a third body having a guide recess configured to guide teeth made of resin monofilaments, each of the first to third bodies on which the common part is mountable; and a pull-tab having a shaft which is positioned between the cover portion 15 and the at least one body.

(8) The slider according to (7), wherein the at least one body from among the first to third bodies is provided with a pawl engagement position-changing means.

(9) The slider according to (7) or (8), wherein at least one body from among the first to third bodies is configured such that a slider centerline that passes through a lateral center of the body and an engagement centerline that passes through a lateral center of left and right rows of teeth which engage with each other are located at different positions.

(10) The slider according to (7) or (8), wherein at least two bodies from among the first to third bodies are configured so as to have different values of distance from a slider centerline that passes through a lateral center of the respective bodies to an engagement centerline that passes through a lateral center of left and right rows of teeth which engage with each other.

(11) The slider according to (7) or (8), wherein at least two bodies from among the first to third bodies are configured so as to have different values of distance from a pawl hole through which the stopping pawl portion protrudes into the guide recess to an engagement centerline that passes through a lateral center of left and right rows of teeth which engage with each other in a lateral direction of the bodies.

(12) The slider according to any one of (7) to (11), wherein the stopping pawl portion and the cover portion are integrally provided as one component.

Advantageous Effects of Invention

According to the method for manufacturing a slider for a slide fastener with an automatic stopper according to the present invention, the common part, which includes the stopping pawl portion, the biasing portion and the cover portion is mounted on one body selected from the at least two bodies on each of which the common part can be mounted, the at least two bodies being from among the first body having the guide recess which guides the metal teeth, the second body having the guide recess which guides the resin teeth made by injection molding, and the third body having the guide recess which guides the teeth made of resin monofilaments. Accordingly, it is possible to manufacture the slider for a slide fastener, which has an automatic stopper corresponding to a variety of teeth, and in which the stopping pawl portion possesses a suitable level of engagement retention strength, using components of the automatic stopper as the common part. It is also possible to achieve a reduction in cost due to intensive production of the common part and combined use of manufacturing equipment and an assembling apparatus.

According to the slider for a slide fastener with an automatic stopper according to the present invention, the slider includes the common part, which includes the stopping pawl portion, the biasing portion and the cover portion; any one of the bodies, which is selected from among the first body having the guide recess which guides the metal teeth, the second body having the guide recess which guides the resin teeth made by injection molding, and the third body having the guide recess which guides the teeth made of resin monofilaments, and on which the common part can be mounted; and the pull-tab which has the shaft positioned between the cover portion and any one of the bodies. Accordingly, it is possible to manufacture the slider for a slide fastener, which has an automatic stopper corresponding to a variety of teeth, and in which the stopping pawl portion possesses a suitable level of engagement retention strength, using the components of the automatic stopper as the common part. It is also possible to achieve intensive production of the common part 16 and a reduction in cost by combining the use of manufacturing equipment and an assembling apparatus.

EMBODIMENTS OF INVENTION

Hereinafter, embodiments of a slide for a slide fastener and a method for manufacturing the same according to the present invention will be described in detail with reference to the accompanying drawings.

Figure 4:
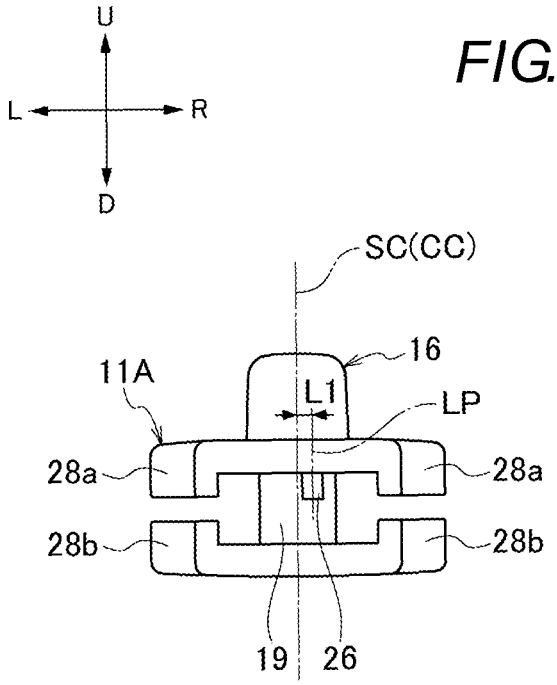
FIG. 4 is a side elevation view at the rear mouth side of the slider showing the position at which the stopping pawl portion protrudes with respect to the cover member in the slider for a slide fastener with an automatic stopper shown in FIG. 1.

As for the slider, an upper side refers to an upper side with respect to the paper surface of FIG. 4, a lower side refers to a lower side with respect to the paper surface of FIG. 4, a front side reference to a depth side with respect to the paper surface of FIG. 4, a rear side refers to a front side with respect to the paper surface of FIG. 4, a left side refers to a left side with respect to the paper surface of FIG. 4, and a right side refers to a right side with respect to the paper surface of FIG. 4. In addition, a 'longitudinal direction' refers to a direction in which the upper side and the lower side of the slider are connected, i.e. a longitudinal direction of the slide fastener when a final product of the slide fastener is placed on a horizontal plane (in other words, a direction in which the slider slides), and a 'lateral direction' refers to a direction in which the left side and the right side of the slider are connected, and is defined as a direction that perpendicularly intersects the 'longitudinal direction,' i.e. a direction that determines the width of the slide fastener. In addition, in the respective figures, reference numeral U indicates the upper side, D indicates the lower side, the Fr indicates the front side, Re indicates the rear side, L indicates the left side, and R indicates the right side.

First Embodiment

Figure 1:
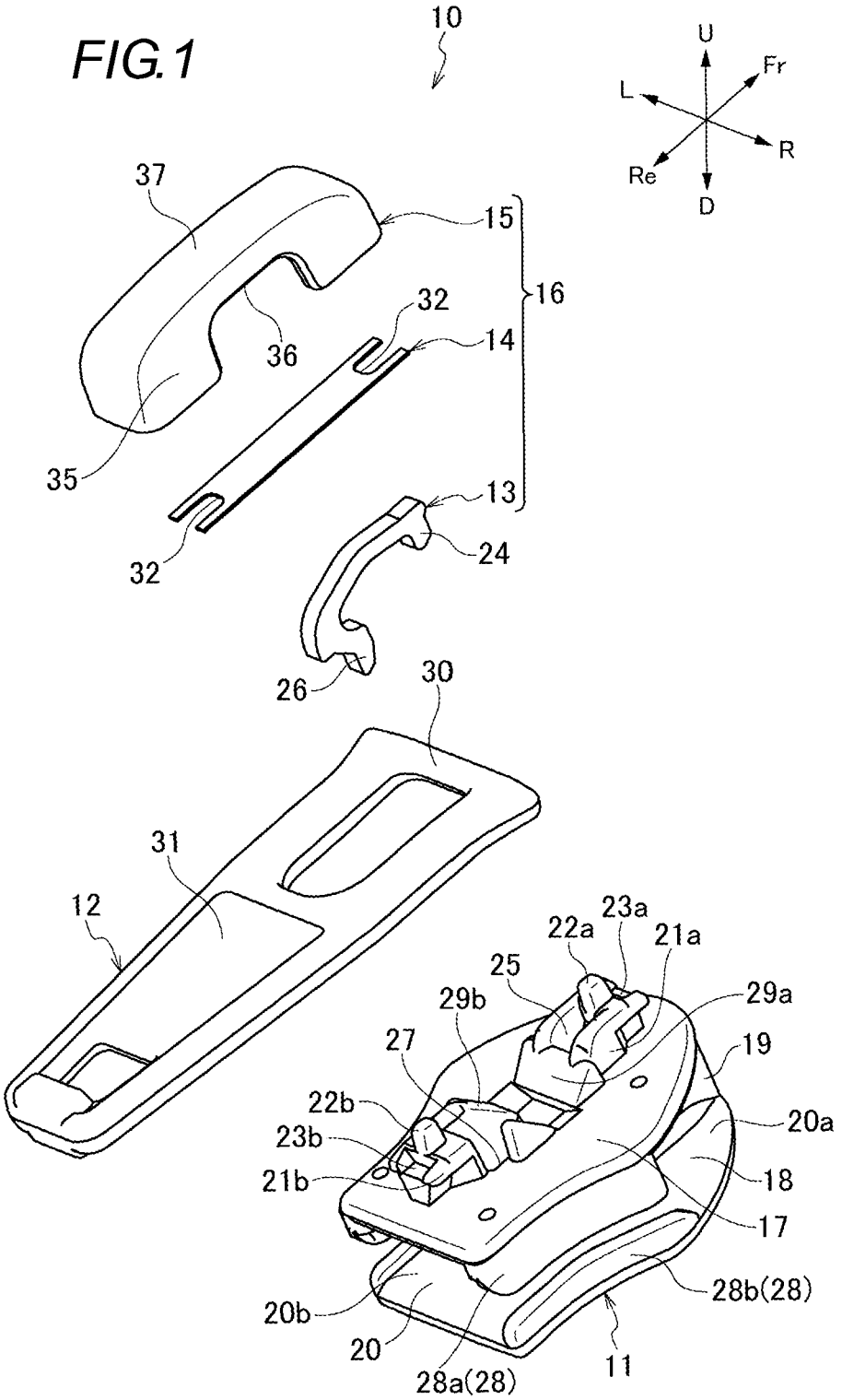
FIG. 1 is an exploded perspective view of a slider for a slide fastener with an automatic stopper according to a first embodiment of the invention.
Figure 2:
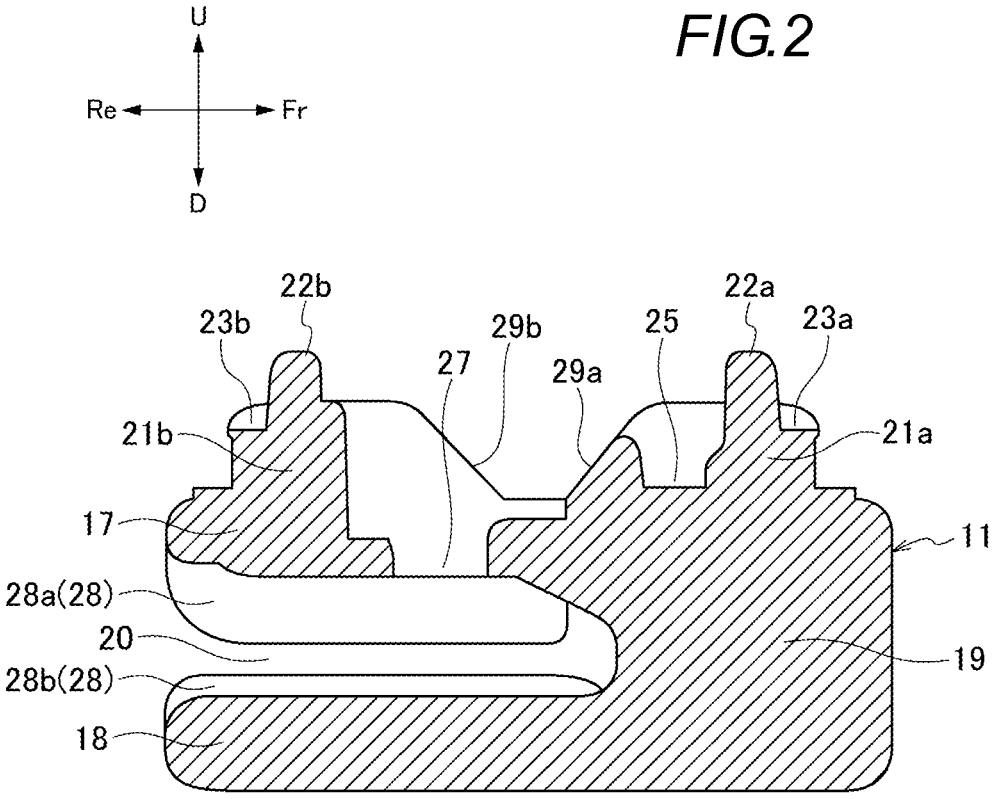
FIG. 2 is a longitudinal view of a body of slider for a slide fastener with an automatic stopper shown in FIG. 1.

FIG. 1 is an exploded perspective view of a slider for a slide fastener with an automatic stopper according to a first embodiment of the invention, and FIG. 2 is a longitudinal view of a body of slider for a slide fastener with an automatic stopper shown in FIG. 1. As shown in FIG. 1 and FIG. 2, the slider 10 for a slide fastener with an automatic stopper (hereinafter, simply referred to as a slider) includes a body 11 (a third body 11C for a coil-shaped fastener is shown in the figures), a pull-tab 12, an engagement pawl plate 13 which has a stopping pawl portion 26, a plate spring 14 which serves as a biasing portion, and a cover portion 15.

These members are formed by die-casting an aluminum alloy, a zinc alloy or the like, by shaping brass, stainless steel or the like using a pressing means, or by shaping a synthetic resin, such as polyamide, polyacetal, polypropylene, polybutylene terephthalate or the like, using an injection molding means.

The body 11 has an upper blade 17 and a lower blade 18 which are spaced apart from each other and arranged parallel to each other, a guide post 19 which connects the front end portion of the upper blade 17 to the front end portion of the lower blade 18, and sidewalls 28 which protrude along both of left and right edges of at least one of the upper blade 17 and the lower blade 18, i.e. upper sidewalls 28*a* which protrude downward along both of the left and right edges of the upper blade 17 and lower sidewalls 28*b* which protrude upward along both of the left and right edges of the lower blade 18 according to this embodiment. Accordingly, between the upper and lower blades 17 and 18, a substantially Y-shaped guide recess 20 which guides teeth is formed by the upper and lower sidewalls 28*a* and 28*b* which are erected from the sides. In addition, left and right shoulder mouths 20*a* which are divided by the guide post 19 are provided in the front side portion of the body 11, and a rear mouth 20*b* is provided in the rear side portion of the body 11. A pair of front and rear attachment posts 21*a* and 21*b* to which the cover portion 15 is to be attached are erected from the shoulder mouth side and the rear mouth side of the upper surface of the upper blade 17, and holding portions 22*a* and 22*b* protrude from the upper surfaces of the attachment posts 21*a* and 21*b* so as to hold the plate spring 14. Receiving portions 23*a* and 23*b* are provided in the front side portion and the rear side portion of the holding portions 22*a* and 22*b* of the holding portions 22*a* and 22*b* which are provided at the shoulder mouth side and the rear mouth side, and protrusions (not shown) which are provided in the cover portion 15 are received in the receiving portions 23*a* and 23*b*.

In the meantime, the 'shoulder mouth side' refers to the side at which rows of teeth which are disengaged from each other exit the guide recess 20, and the 'rear mouth side' refers to the side at which rows of teeth which are engaged with each other exit the guide recess 20.

The front attachment post 21*a* has a dent 25 in the inner base portion, which receives an engagement protrusion 24 which is provided at one end of the engagement pawl plate 13, and the rear attachment post 21*b* has a pawl hole 27 in the inner base portion, into which the stopping pawl portion 26 which is provided at the other end of the engagement pawl plate 13 is fitted. In addition, inclined surface portions 29*a* and 29*b* which guide a shaft 30 of the pull-tab 12 are provided integrally on the upper central portions of the upper plate 17 inside the attachment posts 21*a* and 21*b*. The pawl hole 27 extends through the upper plate 17 in the top-bottom direction and communicates with the guide recess 20. Accordingly, the stopping pawl portion 26 can protrude into the guide recess 20 through the pawl hole 27.

The pull-tab 12 is provided with a knob 31 at one end and the shaft 30 at the other end, and is pivotably attached to the upper surface of the upper blade 17. The engagement pawl plate 13 has the engagement protrusion 24 at one end, which is received in the dent 25 which is provided in the body 11, and the stopping pawl portion 26 at the other end, which is fitted into the pawl hole 27 of the body 11. In addition, the plate spring 14 is formed as a substantially rectangular spring plate, and has recesses 32 at both ends, which receive the holding portions 22*a* and 22*b* of the attachment posts 21 and the protrusions (not shown) which are provided on the inner surface of the upper wall of the cover portion 15.

The cover portion 15 is shaped as a box which is open at the bottom side, and has openings 36 in both sidewalls 35, through which the shaft 30 of the pull-tab 12 is inserted and passes. Protrusions (not shown) are formed at front and rear ends of the inner surface of the upper wall 37, and hold both ends of the plate spring 14.

The slider 10 for a slide fastener with an automatic stopper is mounted by positioning that the shaft 30 of the pull-tab 12 between the inclined surface portions 29*a* and 29*b* which are provided on the upper surface of the body 11, placing the engagement pawl plate 13 over the pull-tab 12 by inserting the engagement protrusion 24 into the dent 25 and inserting the stopping pawl portion 26 into the pawl hole 27, and putting the cover portion 15 from above so as to cover the attachment posts 21*a* and 21*b*. The stopping pawl portion 26 protrudes from and retracts into the pawl hole 27 so as to engage with the teeth, thereby stopping the slider 10 from moving.

Figure 3A:
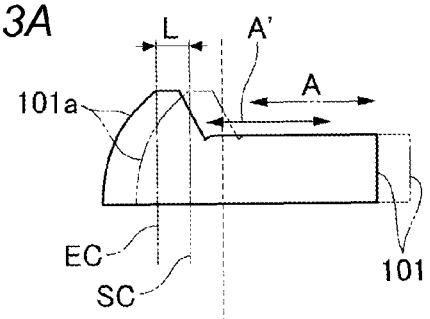
FIGS. 3A to 3F are explanatory views showing the internal structure of each of sliders to which a common part is applied and a suitable engagement range of teeth and a stopping pawl portion in the slider for a slide fastener with an automatic stopper shown in FIG. 1.

However, in the slider 10 for a slide fastener having the above-described configuration, it is difficult to make the body 11 into a complete common part since the optimum guide recess 20 having different shapes corresponding to teeth is required to be formed. Therefore, according to this embodiment, the engagement pawl plate 13, the plate spring 14 and the cover portion 15 which are components of the automatic stopper are designed as a common part 16, and at the same time, the three bodies to which any of the common part 16 can be mounted are provided. The three bodies include a first body 11A having the guide recess 20 which guides metal teeth 101 (FIGS. 3A and 3D), a second body 11B having the guide recess 20 which guides resin teeth 102 made by injection molding (FIGS. 3B and 3E), and a third body 11C having the guide recess 20 which guides teeth 103 made of resin monofilaments (FIGS. 3C and 3F).

In the meantime, as for the pull-tab 12, there are a variety of demands for a shape, design, logo or the like at the customers' request. Therefore, in many cases, it is impossible in practice or unnecessary to make the pull-tab 12 into a common part even though it is technically possible.

That is, as shown in FIG. 4, in the common part 16 according to this embodiment, the stopping pawl portion 26 of the engagement pawl plate 13 protrudes from the bottom of the cover portion 15 at a position that is offset by a predetermined distance L1 in the lateral direction (to the right in the paper surface) from the lateral center CC of the cover portion 15. In the meantime, in FIG. 4, the centerline SC of the slider and the lateral center CC of the cover portion 15 are identical with each other, and an engagement position LP of the stopping pawl portion 26 is offset by the distance L1 from the centerline SC of the slider.

Figure 3B:
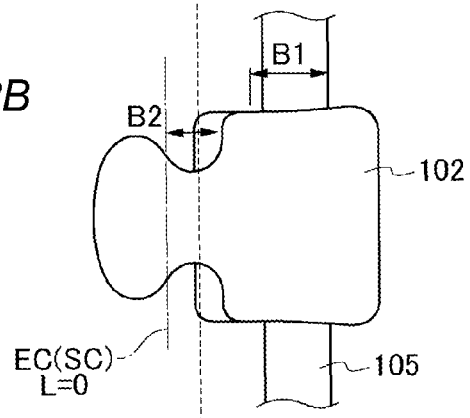
Figure 3C:
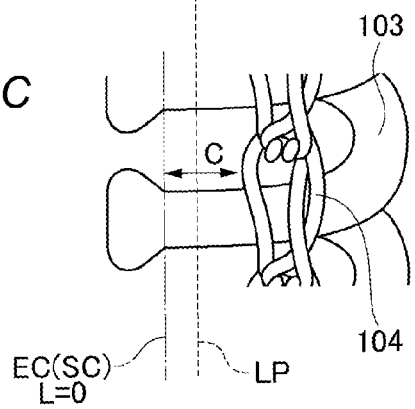
Figure 3D:
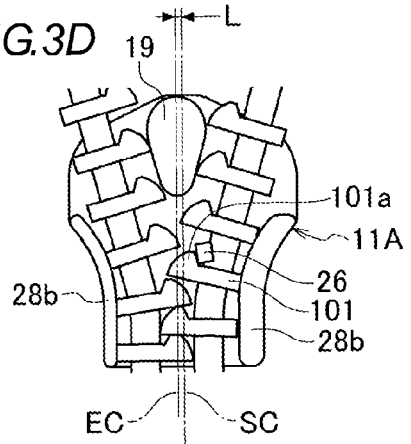
Figure 3E:
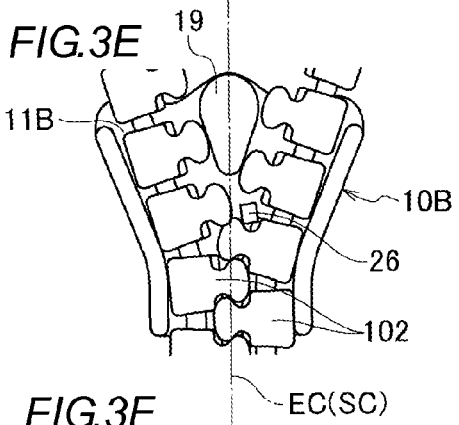
Figure 3F:
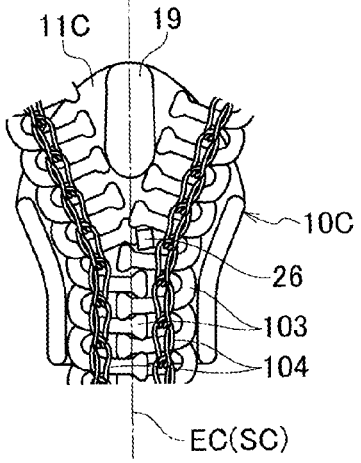

In this case, as shown in FIGS. 3C and 3F, in the third body 11C of the slider 10C for a coil-shaped slider, the stopping pawl portion 26 engages with the coil-shaped teeth 103 within the range of an arrow C. As shown in FIGS. 3B and 3E, in the second body 11B of the slider 10B for an injection resin fastener, the stopping pawl portion 26 engages with the injection resin teeth 102 within the range of an arrow B2. Therefore, the second body 11B and the third body 11C are formed such that the slider centerline SC and the engagement centerline EC are identical with each other (the distance L from the slider centerline SC to the engagement centerline EC=0), and the pawl hole 27 is formed in each of the bodies 11B and 11C corresponding to the engagement position LP of the stopping pawl portion 26.

In the meantime, the first body 11A of the slider 10A for a metal fastener is provided with a pawl engagement position-changing means. The pawl engagement position-changing means is a means for changing the position where the stopping pawl portion 26 engages with the teeth 101 with respect to the engagement centerline EC (when viewed from the engagement centerline EC). It is configured such that the suitable engagement range of an arrow A is offset to an arrow A', i.e. the slider centerline SC and the engagement centerline EC are located at different positions (the engagement centerline EC is located to the left by the distance L with respect to the slider centerline SC), by the pawl engagement position-changing means.

Figure 5A:
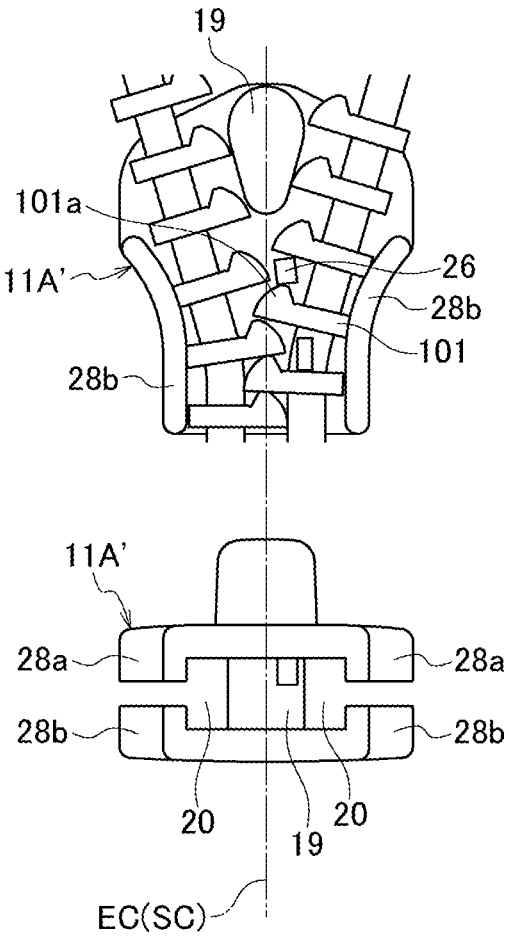
FIG. 5A is a view explaining the positional relationship between teeth and the stopping pawl portion in the slider for a slide fastener using the body which is configured such that a slider centerline SC and an engagement centerline EC are identical with each other.

Specifically, as shown in FIG. 5A, like the third body 11C, in the case of the first body 11A' which is configured such that the slider centerline SC is identical with the engagement centerline EC, the stopping pawl portion 26 interferes with a mountain portion 101*a* which is intended to engage with the metal teeth 101, so that a suitable engagement state is not obtained. Accordingly, the common part 16 cannot be applied.

Figure 5B:
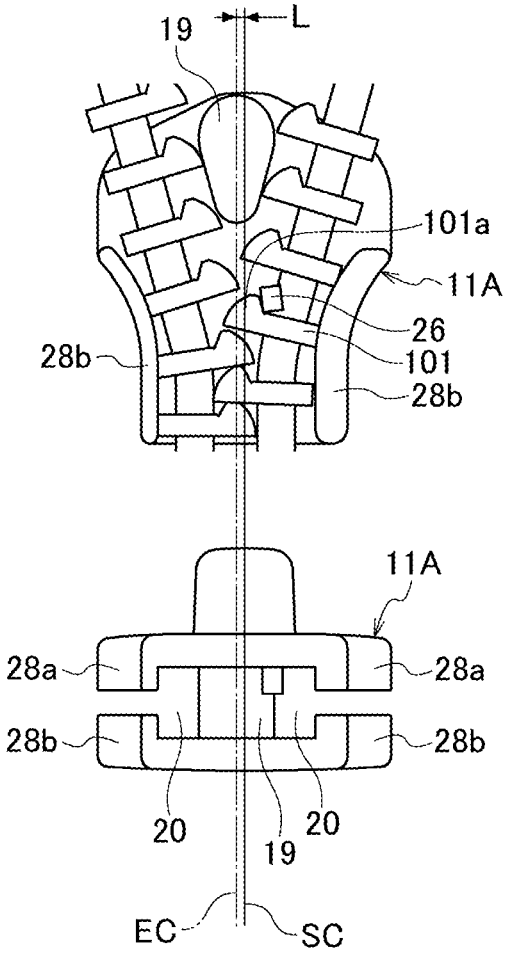
FIG. 5B is a view explaining the positional relationship between teeth and the stopping pawl portion in the slider for a slide fastener with an automatic stopper according to the first embodiment.

Therefore, as shown in FIG. 5B, in the first body 11A which is a component of the slider 10A for a metal fastener, the guide recess 20 is offset by the distance L to the left by increasing the thickness of the sidewalls at one side of the left and right sides (the right side on the paper surface) of the pair of left and right upper sidewalls 28*a* and the pair of left and right lower sidewalls 28*b* which define the guide recess 20 and reducing the thickness of the sidewalls at the other side of the left and right sides (the left side on the paper surface) of the pair of left and right upper sidewalls 28*a* and the pair of left and right lower sidewalls 28*b* which define the guide recess 20. Accordingly, the engagement centerline EC is located to the left from the slider centerline SC, and the stopping pawl portion 26 is within the range of the arrow A', which is the suitable engagement range of the metal teeth 101. This prevents the stopping pawl portion 26 from interfering with the metal teeth 101.

Therefore, the distance between the slider centerline SC and the engagement centerline EC is formed different among the first body 11A, the second body 11B and the third body 11C.

Accordingly, it is possible to manufacture the slider 10A for a metal fastener, the slider 10B for an injection resin fastener and the slider 10C for a coil-shaped fastener by mounting the common part 16 (the engagement pawl plate 13, the plate spring 14 and the cover portion 15) on one body 11 selected from the first to third bodies 11A, 11B and 11C which are prepared in advance.

As described above, according to the method for manufacturing a slider for a slide fastener with an automatic stopper according to this embodiment, the common part 16, which includes the engagement pawl plate 13 having the stopping pawl portion 26, the plate spring 14 and the cover portion 15, and which forms a component of the automatic stopper, is mounted on one body 11 selected from the at least two bodies 11 on each of which the common part can be mounted, the two bodies 11 being from among the first body 11A having the guide recess 20 which guides the metal teeth 101, the second body 11B having the guide recess 20 which guides the resin teeth 102 made by injection molding, and the third body 11C having the guide recess 20 which guides the teeth 103 made of resin monofilaments. Accordingly, it is possible to manufacture the slider 10 for a slide fastener, which has an automatic stopper corresponding to a variety of teeth, and in which the stopping pawl portion 26 possesses a suitable level of engagement retention strength, using components of the automatic stopper as the common part 16. It is also possible to achieve a reduction in cost due to intensive production of the common part 16 and combined use of manufacturing equipment and an assembling apparatus.

In addition, the slider 10 for a slide fastener with an automatic stopper according to this embodiment includes the common part 16, which includes the engagement pawl plate 13, the plate spring 14 and the cover portion 15, and which is a component of the automatic stopper; any one of the bodies 11, which is selected from among the first body 11A having the guide recess 20 which guides the metal teeth 101, the second body 11B having the guide recess 20 which guides the resin teeth 102 made by injection molding, and the third body 11C having the guide recess 20 which guides the teeth 103 made of resin monofilaments, and on which the common part can be mounted; and the pull-tab 12, which has the shaft 30 positioned between the cover portion 15 and any one of the bodies 11. Accordingly, it is possible to manufacture the slider 10 for a slide fastener, which has an automatic stopper corresponding to a variety of teeth, and in which the stopping pawl portion possesses a suitable level of engagement retention strength, using the components of the automatic stopper as the common part 16. It is also possible to achieve intensive production of the common part 16 and a reduction in cost by combining the use of manufacturing equipment and an assembling apparatus.

In addition, since at least one of the two bodies 11 is configured such that the slider centerline SC that passes through the lateral center of the body 11 and the engagement centerline EC that passes through the lateral center of the left and right rows of teeth which engage with each other are located at different positions, when the bodies 11 which have been required to use dedicated parts are simply devised, it is possible to manufacture the slider 10 for a slide fastener with an automatic stopper that corresponds to a variety of teeth using the engagement pawl plate 13, the plate spring 14 and the cover portion 15 as the common part 16.

In addition, since the at least two bodies 11 are configured such that they have different values of the distance L between the slider centerline SC and the engagement centerline EC, when one type of the sliders 10 for a slide fastener with an automatic stopper is set as a base and the other type of the sliders 10 for a slide fastener with an automatic stopper is slightly modified, it is possible to manufacture the slider 10 for a slide fastener with an automatic stopper which corresponds to a variety of teeth using the engagement pawl plate 13, the plate spring 14 and the cover portion 15 as the common part 16.

Modified Embodiment of First Embodiment

In the meantime, in the first body 11A according to the former embodiment, the slider centerline SC and the lateral center CC of the cover portion 15 are set to be identical with each other, and the position of the stopping pawl portion 26 is maintained at a predetermined position of the body 11A. In this state, the position of the engagement centerline EC with respect to the slider centerline SC, i.e. the position of the teeth with respect to the stopping pawl portion 26, is adjusted by changing the position of the guide recess by the thickness of the upper and lower sidewalls 28*a* and 28*b* at the left and right sides of the slider 10, so that the stopping pawl portion 26 can be arranged at a suitable position of each slider. In the meantime, as in the modified embodiment shown in FIG. 6, it is possible to arrange the stopping pawl portion 26 at a suitable position of each tooth by adjusting the position of the stopping pawl portion 26 with respect to the body 11A in the state in which the slider centerline SC and the engagement centerline EC are set to be identical with each other and the position of the teeth with respect to the body 11A is maintained at a predetermined position.

Figure 6:
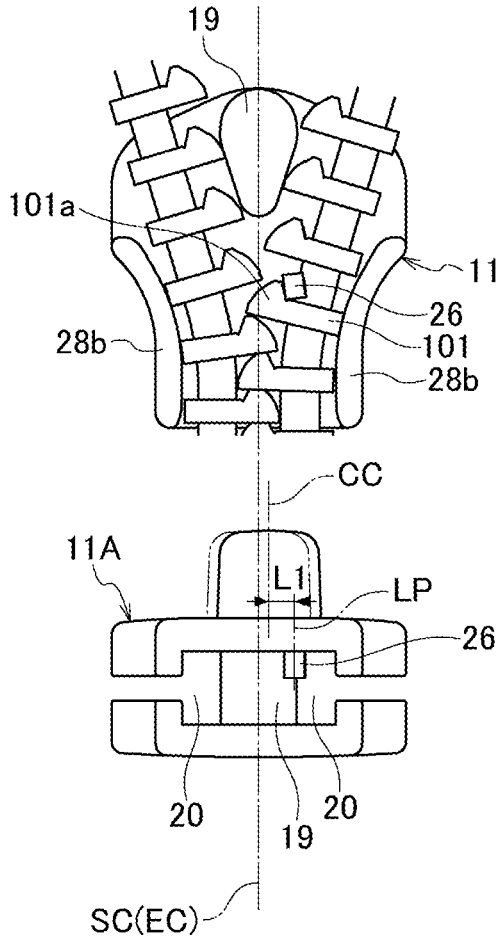
FIG. 6 is view showing the internal structure of a slider for a slide fastener with an automatic stopper according to a modified embodiment of the first embodiment and a side elevation view thereof at the rear mouth side.

Specifically, the first body 11A shown in FIG. 6 is provided with the pawl engagement position-changing means. The engagement position LP of the stopping pawl portion 26 and the position of the pawl position 27 are changed by offsetting the attachment position of the common part 16 with respect to the slider centerline SC, i.e. the lateral center CC of the cover portion 15 with respect to the slider centerline SC. Accordingly, the common part 16 can be shared among the respective bodies 11A, 11B and 11C.

Accordingly, as in the modified embodiment, it is possible to manufacture the slider 10 for a slide fastener with an automatic stopper corresponding to a variety of teeth using the stopping pawl portion 13, the plate spring 14 and the cover portion 15 as the common part 16 by forming the at least two bodies 11 such that they have different values of the distance in the lateral direction of the body 11 between the pawl hole 27 through which the stopping pawl portion 13 protrudes into the guide recess 20 and the slider centerline SC.

Second Embodiment

Next, a slide for a slide fastener and a method for manufacturing the same according to a second embodiment of the present invention will be described with reference to FIG. 7 and FIG. 8.

Figure 7:
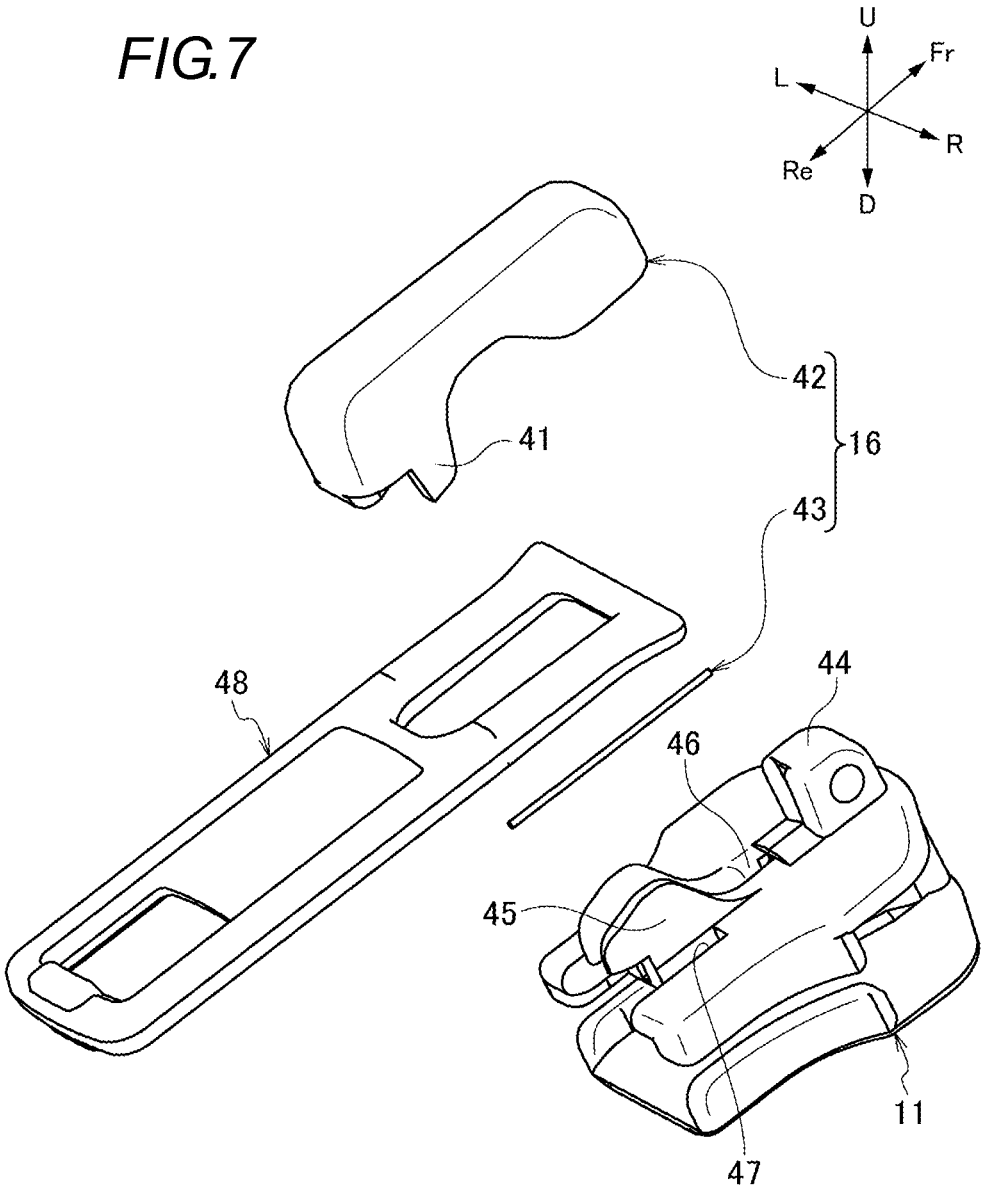
FIG. 7 is an exploded perspective view of a slider for a slide fastener with an automatic stopper according to a second embodiment of the invention.

While the common part 16 according to the first embodiment has three components including the engagement pawl plate 13 having the stopping pawl portion 26, the plate spring 14 and the cover portion 15, the common part 16 according to this embodiment shown in FIG. 7 includes a cover portion 42 which has a stopping pawl portion 41 integrally formed on the rear lower portion and a rod-shaped spring 43 which serves as a biasing portion.

Figure 10:
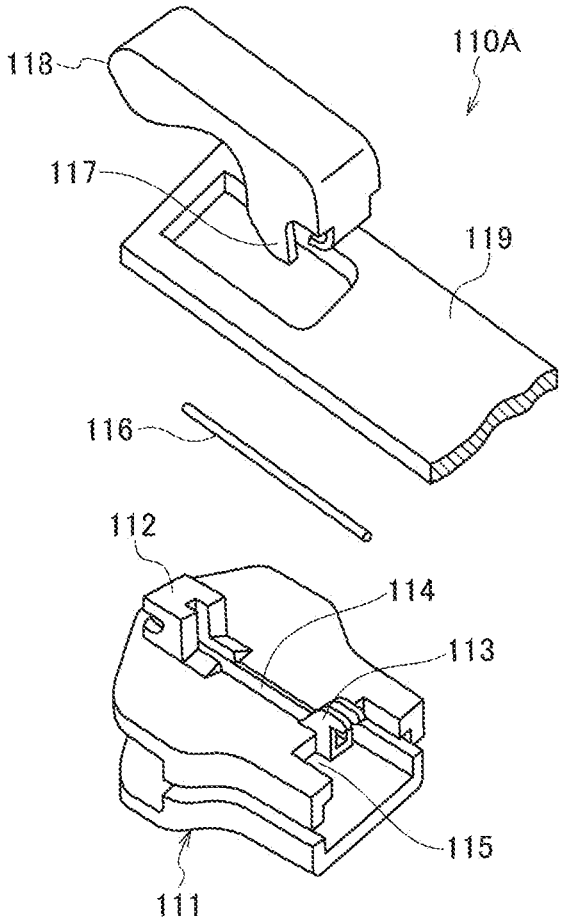
Prior Art FIG. 10
FIG. 10 is an exploded perspective view showing a slider for a slide fastener with an automatic stopper of the related art.
Figure 11:
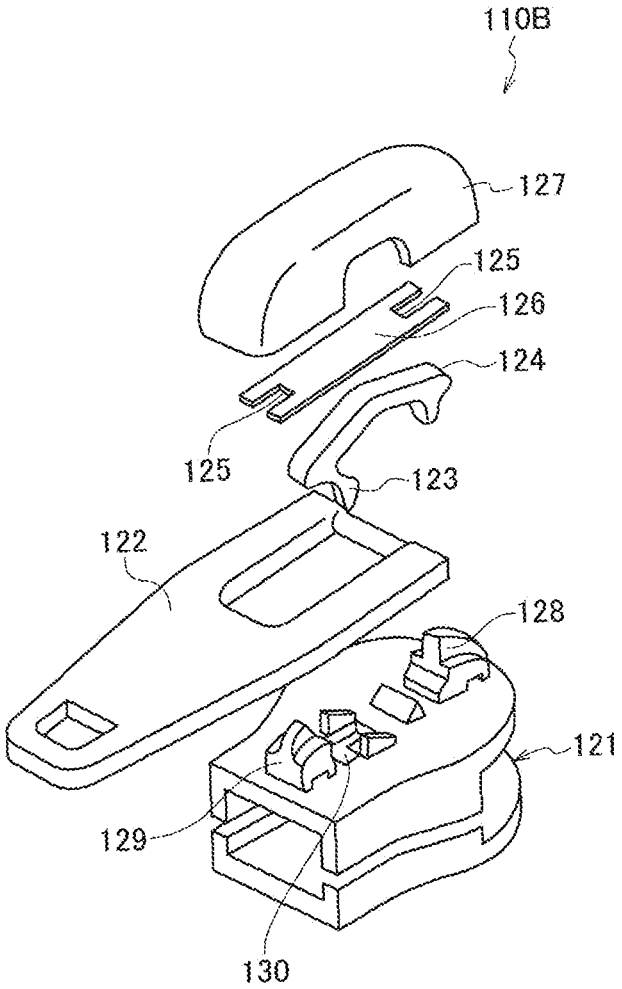
Prior Art FIG. 11
FIG. 11 is an exploded perspective view showing another slider for a slide fastener with an automatic stopper of the related art.

In the meantime, like the related art shown in FIG. 10, the slider 10 is configured such that a stay 44, an engagement post 45, a recess 46 and a pawl hole 47 are provided in the upper surface of the body 11 and the rod-shaped spring 43 is fitted into the recess 46. In addition, a pull-tab 48 is disposed between the rod-shaped spring 43 and the cover portion 42 which has the stopping pawl portion 41 integrally protruding from the rear lower portion, and the cover portion 42 is engaged with the stay 44 and the engagement post 45.

Figure 8:
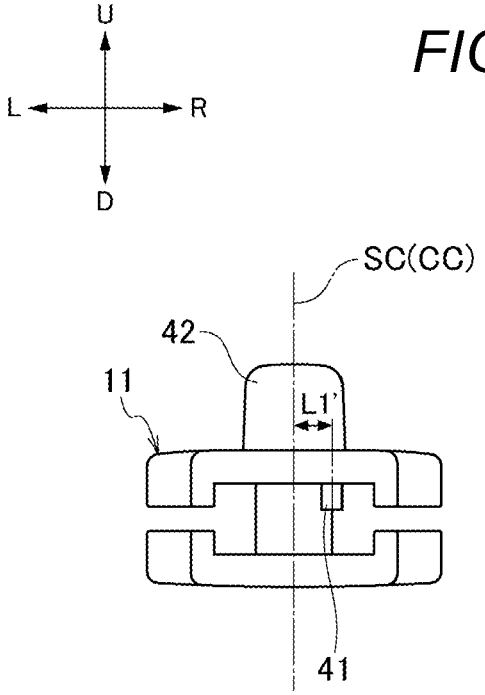
FIG. 8 is a side elevation view at the rear mouth side of the slider showing the position at which the stopping pawl portion protrudes with respect to the cover member in the slider for a slide fastener with an automatic stopper shown in FIG. 7.

That is, as shown in FIG. 8, in the common part 16 according to this embodiment, the stopping pawl portion 41 of the cover portion 42 protrudes from the undersurface of the cover portion 42 at the position where it is offset by a predetermined distance L1' in the later direction (to the right on the paper surface) from the lateral center CC of the cover portion 42.

Figure 9A:
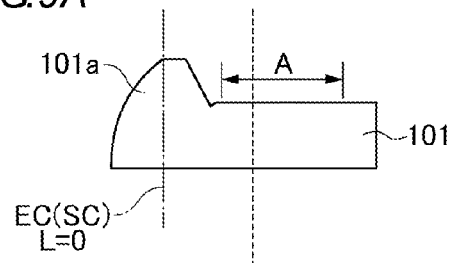
FIGS. 9A to 9F are explanatory views showing the internal structure of each slider to which a common part is applied in the slider for a slide fastener with an automatic stopper shown in FIG. 7 and a suitable engagement range between teeth and the stopping pawl portion.
Figure 9B:
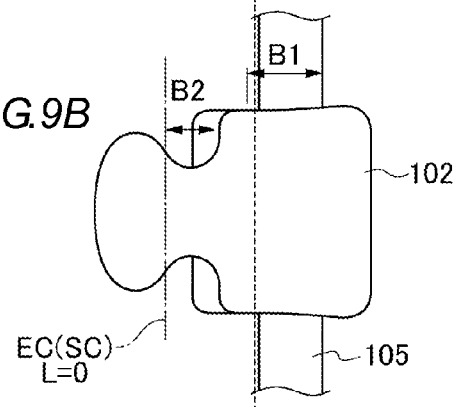
Figure 9C:
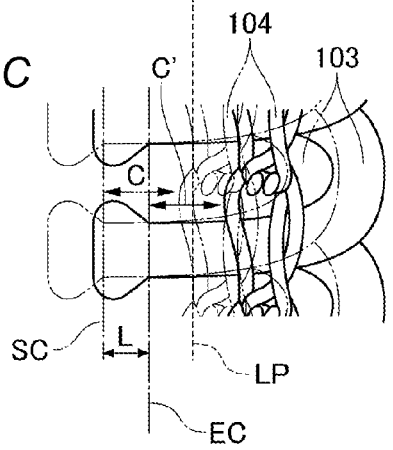
Figure 9D:
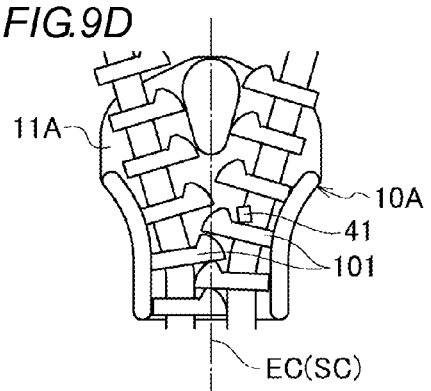
Figure 9E:
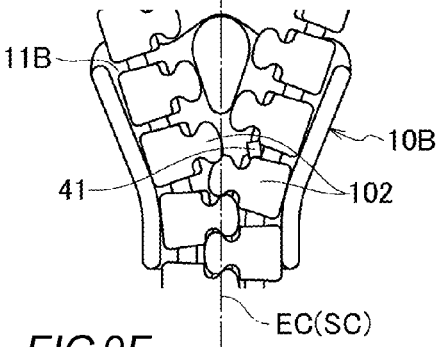

When the common part 16 according to this embodiment is used, as shown in FIGS. 9A and 9D, the stopping pawl portion 41 engages with the metal teeth 101 within the range of an arrow A in the first body 11A of the slider 10A for a metal fastener. As shown in FIGS. 9B and 9E, the stopping pawl portion 41 engages with the injection resin teeth 102 within the range of an arrow B1 in the second body 11B of the slider 10B for an injection resin fastener. Therefore, the first body 11A and the second body 11B are configured such that the slider centerline SC and the engagement centerline EC are identical with each other (the distance L from the slider centerline SC to the engagement centerline EC=0), and the pawl hole 47 is formed in each of the bodies 11B and 11C corresponding to the position where the stopping pawl portion 41 protrudes.

Figure 9F:
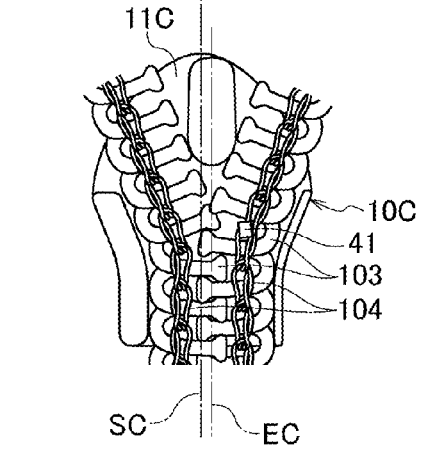

In the meantime, as shown in FIGS. 9C and 9F, the third body 11C of the slider 10C for a coil-shaped fastener is provided with the pawl engagement position-changing means such that the suitable engagement range of an arrow C is offset to an arrow C', i.e. the slider centerline SC and the engagement centerline EC are located at different positions (the engagement centerline EC is located to the right by the distance L with respect to the slider centerline SC). Specifically, as in the first embodiment, the stopping pawl portion 41 is set within the range of the arrow C' that is the suitable engagement range of the coil-shaped teeth 103 by offsetting the guide recess 20 to the right by the distance L such that the stopping pawl portion 41 does not overlap a sewing thread 104 by reducing the thickness of the sidewalls at one side of the left and right sides (the right side on the paper surface) of the pair of left and right upper sidewalls 28*a* and the pair of left and right lower side walls 28*b* and increasing the thickness the thickness of the sidewalls at the other side of the left and right sides (the left side on the paper surface) of the pair of left and right upper sidewalls 28*a* and the pair of left and right lower side walls 28*b*.

Accordingly, it is possible to manufacture the slider 10A for a metal fastener, the slider 10B for an injection resin fastener and the slider 10C for a coil-shaped fastener by mounting the common part 16 (the rod-shaped spring 43 and the cover portion 42 having the stopping pawl portion 41) on one body 11 selected from the first to third bodies 11A, 11B and 11C which are prepared in advance.

In the meantime, according to the second embodiment, as in the modified embodiment of the first embodiment, it is possible to manufacture the slider 10A for a metal fastener, the slider 10B for an injection resin fastener and the slider 10C for a coil-shaped fastener by changing the engagement position LP of the stopping pawl portion 41 and the position of the pawl hole 47 by offsetting the position where the common part 16 is attached, i.e. the lateral center CC of the cover portion 42, with respect to the slider centerline SC.

OTHER MODIFIED EMBODIMENT

Figure 13A:
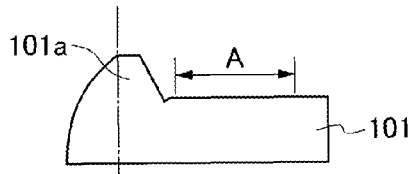
FIGS. 13A to 13F are explanatory views showing the internal structure of each slider and a suitable engagement range between teeth and the stopping pawl portion.
Figure 13B:
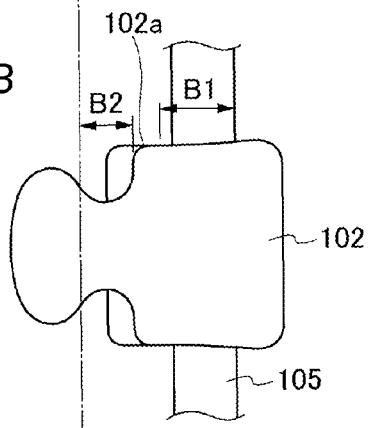
Figure 13C:
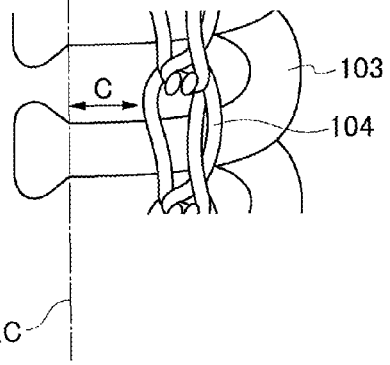
Figure 13D:
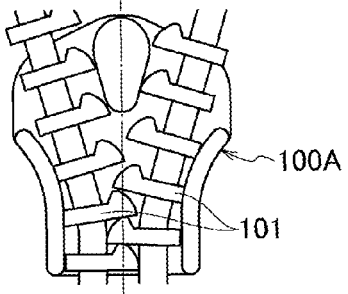
Figure 13E:
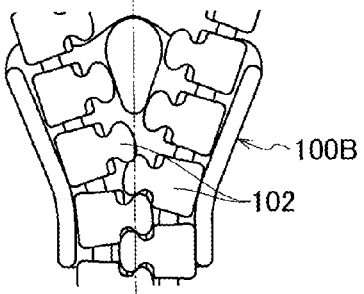
Figure 13F:
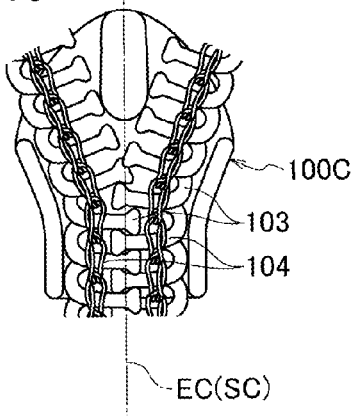

The second body 11B of the slider 10B for an injection resin fastener can also be designed such that the stopping pawl portion 26 is located to avoid the range which is unstable since the engagement position is not set to one position, i.e. the range between arrows B1 and B2 around shoulders 102*a* of the resin teeth 102 (refer to FIG. 13B). Specifically, the slider having the type of the common part 16 described in the first or second embodiment is employed as the slider 10B for an injection resin fastener, and in addition, one of the above-described pawl engagement position-changing means is provided in the second body 11B of the slider 10B for an injection resin fastener.

In the meantime, in the second body 11B of the slider 10B for an injection resin fastener, it is preferable that the engagement position LP of the stopping pawl portion 26 is located at a lateral middle position of the core string 105 in the suitable engagement range of the stopping pawl portion 26 of the arrow B1. For this, the second body 11B can also be formed such that the slider centerline SC and the engagement centerline EC are located at different positions or the position where the common part 16 is attached to the body 11 is changed with respect to the slider centerline SC.

In addition, according to the invention, it is possible to adjust the engagement position of the stopping pawl portions 26 and 41 with respect to the teeth to an optimum position by changing the shape of the teeth, for example, using a means for making the teeth 101, 102 and 103 at one side (at the right to the paper surface) of the pair of left and right teeth be longer (or shorter) than the teeth at the other side (at the left to the paper surface), or using a means for increasing the suitable engagement range by designing the teeth to be sufficiently long compared to the size of the stopping pawl portions 26 and 41.

Figure 12:
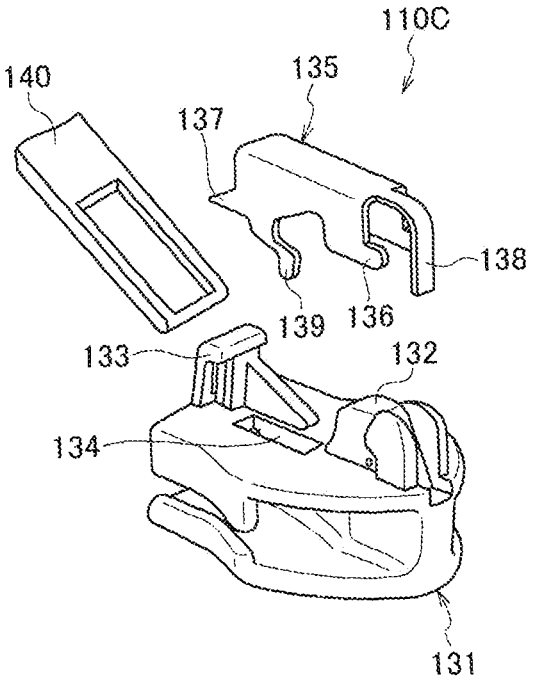
Prior Art FIG. 12
FIG. 12 is an exploded perspective view showing a further slider for a slide fastener with an automatic stopper of the related art.

In addition, while the above-described embodiment has been described that the three components including the stopping pawl portion, the plate spring and the cover portion which form the automatic stopper are made into a common part, or that the stopping pawl portion and the cover portion are integrally formed and the two components including the cover portion and the rod-shaped spring are made into a common part, the present invention can also be applied to a case of the related art shown in FIG. 12 in which the stopping pawl portion 139, the elastic piece (biasing portion) and the cover (cover portion) are integrally formed as a common part.

Hereinafter, a more detailed description will be given to a manufacturing process that is common to the embodiments and the modified embodiments as described above.

First, the common part 16 which has the stopping paw portion 26, 41 or 139, the biasing portion 14, 43 or 138 and the cover portion 15, 42 or 135 and forms the automatic stopper is prepared. In this case, the stopping pawl portion 139, the biasing portion 138 and the cover portion 135 may be prepared as one integral common part. In addition, the stopping pawl portion 41 and the cover portion 42 may be manufactured as an integrated component, the biasing portion 43 may be manufactured as a separate spring component, and the common part may be formed of these two components.

In sequence, at least two bodies 11 from among the first body 11A having the guide recess 20 which guides the metal teeth 101, the second body 11B having the guide recess 20 which guides the resin teeth 102 formed by injection molding, and the third body 11C having the guide recess 20 which guides the teeth 103 made of resin monofilaments are manufactured in advance, and at least one body of the at least two bodies 11 is additionally provided with the pawl engagement position-changing means. In this case, in the body 11 provided with the pawl engagement position-changing means, the position where the stopping pawl portion engages with the teeth is changed with respect to the engagement centerline EC (when viewed from the centerline EC) when compared to the other bodies 11.

In sequence, any pull-tab which is to be attached between the common part 16 and the body 11 is prepared. In addition, the prepared common part 16 is mounted on one body 11A, 11B or 11C selected from among the at least two bodies 11. In the meantime, the pull-tab may be attached simultaneously with the mounting process or later in a separate process.

This assembly may be mass-produced using a known automatic assembling machine, or be manually produced when mounting a specific pull-tab.

In addition, the present invention is not limited to the above-illustrated embodiments, but may be properly changed or improved.

The sidewalls 28 which protrude along both of the left and right edges of at least one of the upper blade 17 and the lower blade 18 may be configured such that they have any one of the upper sidewalls 28*a* and the lower sidewalls 28*b*.

DESCRIPTION OF REFERENCE NUMERALS

10, 10A, 10B, 10C Slider for Slide Fastener With Automatic Stopper
11 Body
11A First Body (Body)
11B Second Body (Body)
11C Third Body (Body)
12 Pull Tab
13 Engagement Pawl Plate
14 Plate Spring (Biasing Portion)
15, 42 Cover Portion
16 Common Part
20 Guide Recess
26, 41, 139 Stopping Pawl Portion
27 Pawl Hole
30 Shaft
43 Rod-Shaped Spring (Biasing Portion)
101 Metal Tooth
102 Resin Tooth
103 Coil-Shaped Tooth
135 Cover (Cover Portion)
138 Elastic Piece (Biasing Portion)
EC Engagement Centerline
LP Engagement Position
SC Slider Centerline
L Distance from Slider Centerline to Engagement Centerline

The invention claimed is:

1. A method for manufacturing a slider for a slide fastener with an automatic stopper, comprising:

preparing a common part which includes a stopping pawl portion, a biasing portion and a cover portion and forms the automatic stopper;

preparing at least two bodies selected from among a first body having a guide recess configured to guide metal teeth, a second body having a guide recess configured to guide resin teeth which are formed by injection molding, and a third body having a guide recess configured to guide teeth made of resin monofilaments; and mounting the common part on one of the bodies selected from the at least two bodies.

2. The method according to claim 1, wherein at least one body of the at least two bodies is provided with a pawl engagement position-changing means.

3. The method according to claim 1, wherein one of the at least two bodies is configured such that a slider centerline that passes through a lateral center of the body and an engagement centerline that passes through a lateral center of left and right rows of teeth which engage with each other are located at different positions.

4. The method according to claim 1, wherein the at least two bodies are configured so as to have different values of distance from a slider centerline that passes through a lateral center of the respective bodies to an engagement centerline that passes through a lateral center of left and right rows of teeth which engage with each other.

5. The method according to claim 1, wherein the at least two bodies are configured so as to have different values of distance from a pawl hole through which the stopping pawl portion protrudes into the guide recess to an engagement centerline that passes through a lateral center of left and right rows of teeth which engage with each other in a lateral direction of the bodies.

6. The method according to claim 1 wherein the stopping pawl portion and the cover portion are integrally provided as one component.

7. A slider for a slide fastener with an automatic stopper, comprising:

a common part which includes a stopping pawl portion, a biasing portion and a cover portion and forms the automatic stopper, wherein the common part is capable of mounting on at least two bodies, each body having a different guide recess, and each of the at least two bodies are selected from among a first body having a guide recess configured to guide metal teeth, a second body having a guide recess configured to guide resin teeth which are formed by injection molding, and a third body having a guide recess configured to guide teeth made of resin monofilaments;

a selected body, wherein the selected body is selected from among the first body, the second body, and the third body; and a pull-tab having a shaft which is positioned between the cover portion and the selected body.

8. The slider according to claim 7, wherein one of the at least two bodies from among the first to third bodies is provided with a pawl engagement position-changing means.

9. The slider according to claim 7, wherein one of the at least two bodies from among the first to third bodies is configured such that a slider centerline that passes through a lateral center of the body and an engagement centerline that passes through a lateral center of left and right rows of teeth which engage with each other are located at different positions.

10. The slider according to claim 7 wherein the at least two bodies from among the first to third bodies are configured so as to have different values of distance from a slider centerline that passes through a lateral center of the respective bodies to an engagement centerline that passes through a lateral center of left and right rows of teeth which engage with each other.

11. The slider according to claim 7, wherein the at least two bodies from among the first to third bodies are configured so as to have different values of distance from a pawl hole through which the stopping pawl portion protrudes into the guide recess to an engagement centerline that passes through a lateral center of left and right rows of teeth which engage with each other in a lateral direction of the bodies.

12. The slider according to claim 7, wherein the stopping pawl portion and the cover portion are integrally provided as one component.

* * * * *